United States Patent [19]

Helms

[11] 4,401,248

[45] Aug. 30, 1983

[54] COMPOSITE MOLDED PLASTIC AND PAPERBOARD DISPENSING DEVICE

[75] Inventor: Charles R. Helms, Malvern, Pa.

[73] Assignee: Container Corporation of America, Chicago, Ill.

[21] Appl. No.: 269,418

[22] Filed: Jun. 1, 1981

[51] Int. Cl.[3] ..... B65D 85/672

[52] U.S. Cl. ..... 225/47; 225/48; 225/66; 225/77; 225/91; 242/55.53

[58] Field of Search ..... 225/47–49, 225/77–80, 65, 66, 91; 242/55.53; 206/467, 461

[56] References Cited

U.S. PATENT DOCUMENTS

| | | | |
|---|---|---|---|
| 464,378 | 12/1891 | Morgan | 242/55.53 |
| 2,118,791 | 5/1938 | Hines, Jr. | 225/47 |
| 2,743,009 | 4/1956 | Williamson et al. | 225/48 X |
| 3,011,688 | 12/1961 | Klein et al. | 225/47 |
| 3,092,294 | 6/1963 | Holcombe | 225/47 |
| 3,743,151 | 7/1973 | Malcolm | 225/47 |
| 3,815,801 | 6/1974 | Perrin | 225/47 |
| 3,972,459 | 8/1976 | Cooper | 225/47 |

FOREIGN PATENT DOCUMENTS

| | | | |
|---|---|---|---|
| 646235 | 8/1962 | Canada | 225/47 |

*Primary Examiner*—Frank T. Yost

*Attorney, Agent, or Firm*—Richard W. Carpenter; Davis Chin

[57] ABSTRACT

A dispensing container formed of molded plastic and paperboard includes a pair of integral, molded plastic cylindrical supporting members bonded by the insert injection molding process to opposing surfaces of end walls of housing structure and is adapted for cooperation with each other to support a roll containing material to be dispensed from the roll. At the same time the supporting members are formed, an integral, molded plastic cutting member is also bonded by the insert injection molding process to the housing and extends between the end walls thereof for cutting material dispensed from the roll.

7 Claims, 10 Drawing Figures

COMPOSITE MOLDED PLASTIC AND PAPERBOARD DISPENSING DEVICE

BACKGROUND OF THE INVENTION

1. Field of the Invention:

This invention relates to dispensing devices, and more particularly to a composite molded plastic and paperboard device for dispensing material such as cellophane tape or wax paper from a spool or roll.

2. Description of the Prior Art:

A state of the art search directed to the subject matter of this application uncovered the following U.S. Pat. Nos.: 464,378; 1,521,369; 2,118,791; 2,825,451; 2,921,674; 3,047,143; 3,086,309; 3,102,671; 3,371,774; 3,403,869; 3,815,801; 3,972,459; 4,091,927.

None of the prior art patents uncovered in the search disclosed a dispensing container formed of molded plastic and paperboard in the same manner as that of applicant's invention, and which included a pair of integral molded plastic cylindrical supporting members bonded to opposing surfaces of end walls of housing structure and adapted for cooperation with each other to support a roll containing material to be dispensed from the roll, as well as an integral, molded plastic cutting member bonded to the housing and extending between the end walls thereof for cutting material dispensed from the roll.

SUMMARY OF THE INVENTION

An object of the invention is to provide an improved type of dispensing device which is suitable for dispensing material such as cellophane tape, wax paper, aluminum foil, or other materials from a roll.

A more specific object of the invention is the provision of a dispensing device which is a composite molded plastic and paperboard material formed by an insert molding process.

These and other objects of the invention will be apparent from an examination of the following description and drawings.

Figure 3:
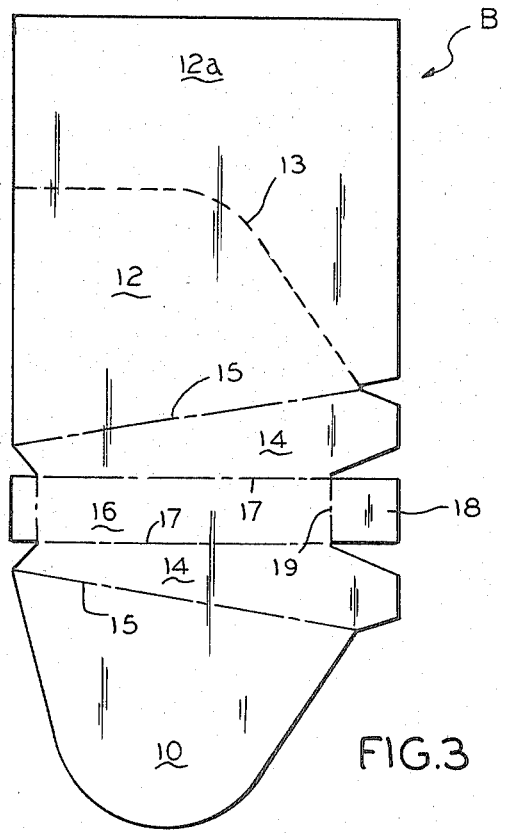
FIG. 3 is a plan view of a blank of foldable sheet material from which the housing or frame of the structure illustrated in the other views may be formed.

It will be understood that, for purposes of clarity, certain elements may have been intentionally omitted from certain views, where they are believed to be illustrated to better advantage in other views.

DESCRIPTION OF THE PREFERRED EMBODIMENTS

Referring now to the drawings for a better understanding of the invention, and more particularly to FIGS. 1 through 5, it will be seen that this embodiment of the invention is a dispensing device, formed of paperboard and plastic, which is adapted to hold a roll or spool of relatively narrow material, such as cellophane tape, whereby the material can be dispensed from the roll. The dispensing device indicated generally at D includes a frame or housing indicated generally at F, which is formed primarily from paperboard, and a roll supporting core or spool indicated generally at S, which is formed from molded plastic material.

The frame or housing F is formed from a unitary blank B of foldable paperboard illustrated in FIG. 3. The actual construction of the entire dispensing device is accomplished in generally the same manner as the article described in U.S. Pat. No. 3,397,814. In this type of construction the paperboard portion of the article, the blank B, is inserted into a mold, and then plastic is injected to form the core or spool S as well as the cutting element and other plastic elements hereinafter described and, at the same time, bond the plastic elements to the paperboard elements.

As best seen in FIG. 3, the frame or housing F includes a pair of opposed upper end wall panels 10 and 12. Formed integrally, with end wall panel 12 is a display panel 12*a*, which is detachably joined to upper end wall panel 12 by a weakened line of tear 13.

A pair of lower end wall panels 14 are foldably joined along fold lines 15 to the lower edges of upper end wall panels 10 and 12. Lower end wall panels 14 are connected to each other by a bottom wall panel 16 which is foldably joined along its opposite side edges at fold lines 17 to related lower edges of respective end wall lower panels 14. Foldably joined to the front edge of bottom wall 16 along a fold line 19 is a front flap 18.

Figure 4:
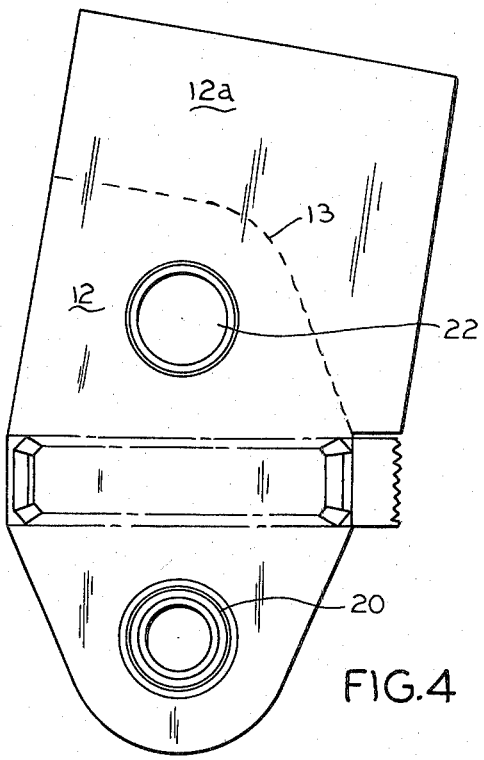
FIG. 4 is a view similar to FIG. 1, but illustrating the device in the early stages of formation after the plastic components have been bonded to the paperboard component.
Figure 5:
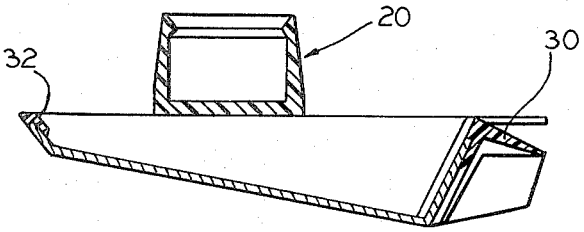
FIG. 5 is a side elevational view, partly in transverse cross-section, of a portion of the structure illustrated in FIG. 4.

Now referring particularly to FIGS. 4 and 5, it will be seen that bonded to the inner or opposed surfaces of upper end wall panels 10 and 12 are a pair of generally cylindrically-shaped core or spool portions 20 and 22, respectively.

Figure 1:
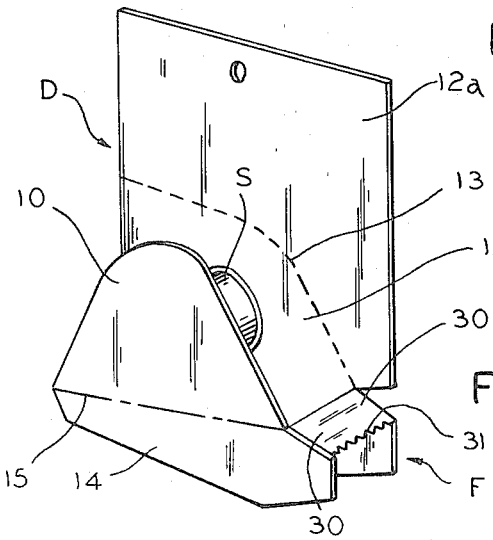
FIG. 1 is a perspective view of one form of a dispensing device embodying features of the invention.
Figure 2:
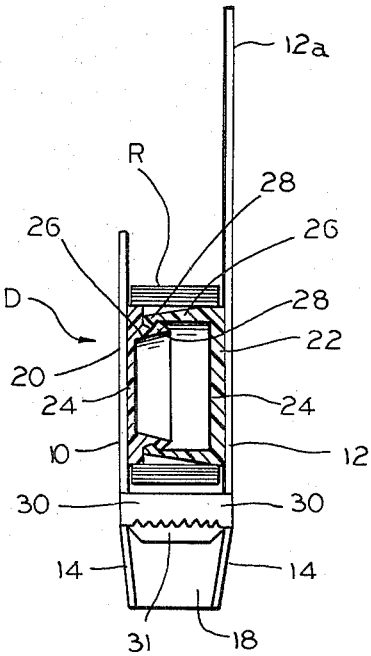
FIG. 2 is a transverse vertical cross section of the structure illustrated in FIG. 1.

Each of these elements 20 and 22 includes a base portion 24, which is bonded to the related upper end wall panel, and a generally cylindrical skirt portion 26 projecting therefrom for engagement with the skirt portion of the opposite element in a manner hereinafter described. Each of the skirts 26 are provided with a locking flange 28, so that when the upper and lower end wall panels are folded up into parallel relationship with each other, as shown in FIGS. 1 and 2, the spool elements 20 and 22 can be snapped into telescoping relationship with their locking flanges engaging each other in interlocking relationship to form a solid core or spool for supporting a roll (not shown) of material to be dispensed. Obviously, the roll of material to be dispensed must be placed over one of the spool elements before the spool elements are brought into interlocking relationship with each other.

At the same time the spool elements 20 and 22 are molded with the paperboard blank B there is also formed, by the same molding process, a cutting strip 30 which extends between the two side wall panels and is provided with a serrated edge 31 to aid in cutting the material to be dispensed from the remaining portion of the material on the roll.

At the same time the spool elements and cutting strip are molded, there is also molded a rear reinforcing structure 32 which extends across the rear of the dispensing device and joints the lower side wall panels 14 to the bottom wall panels 16 and the upper side wall panels 10 and 12 to form the rear portion of the structure.

Thus, it will be seen that this embodiment of the invention provides a device of relatively simple design and construction wherein the plastic and paperboard portions can be molded and bonded together in a common insert molding process.

Turning now to FIGS. 6 through 10, it will be seen that a slightly modified form of the invention is shown. This embodiment is also a dispensing device utilizing the basic principles of the previous embodiment, except that the frame or housing is much wider to accommodate a wider roll of material to be dispensed such as wax paper, plastic film, or metal foil.

Figure 6:
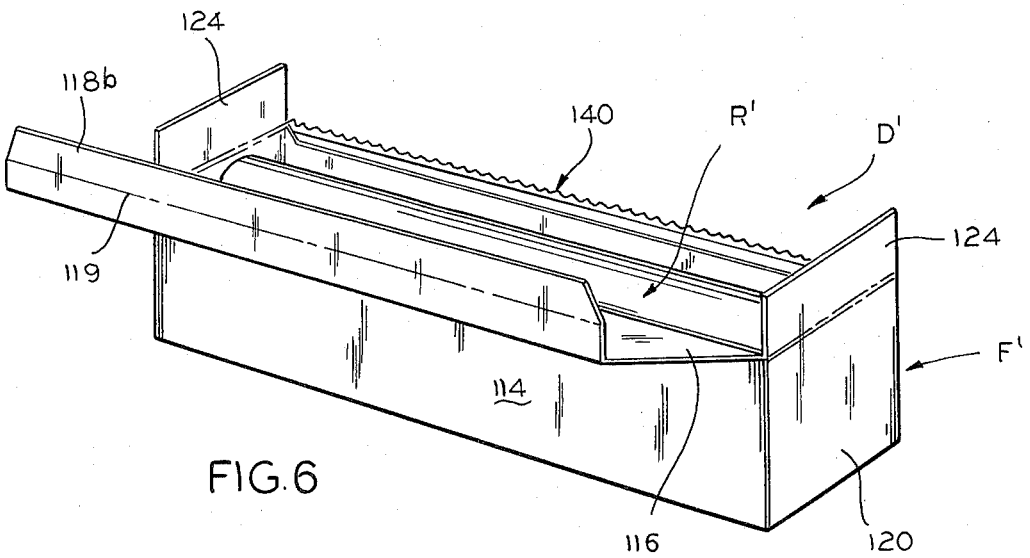
FIGS. 6, 7 and 8 are views similar to FIGS. 1, 2 and 3, respectively, but illustrate a modified form of the invention.
Figure 10:
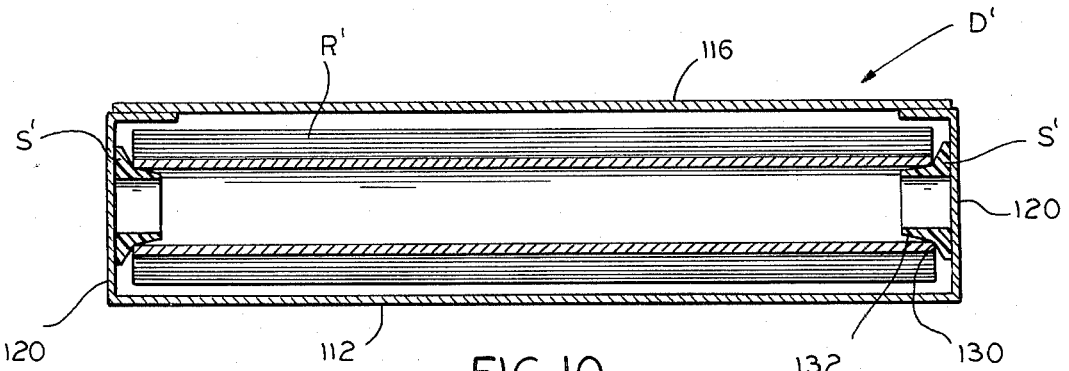
FIG. 10 is a transverse vertical cross-section of the structure illustrated in FIG. 6.
Figure 7:
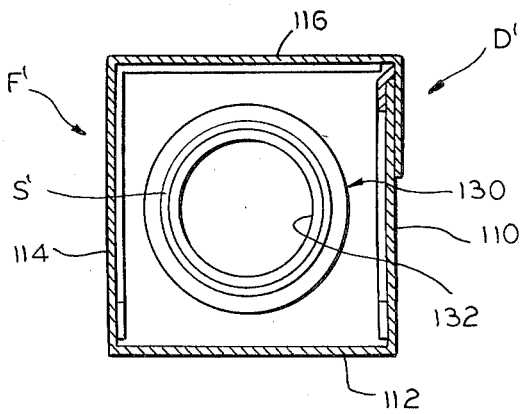

Referring now to FIGS. 6 through 10, it will be seen that the dispensing device D', illustrated in FIGS. 6, 7 and 10, is adapted to support an elongated roll R' of materials such as wax paper, plastic film, aluminum foil or the like. Dispenser D' includes a paperboard frame or housing indicated generally at F' which may be formed from a unitary blank B' of paperboard illustrated in FIG. 8. Dispenser D' also includes a pair of molded plastic supports S' which are bonded to the end walls of the frame in a manner described later in the specification.

Figure 8:
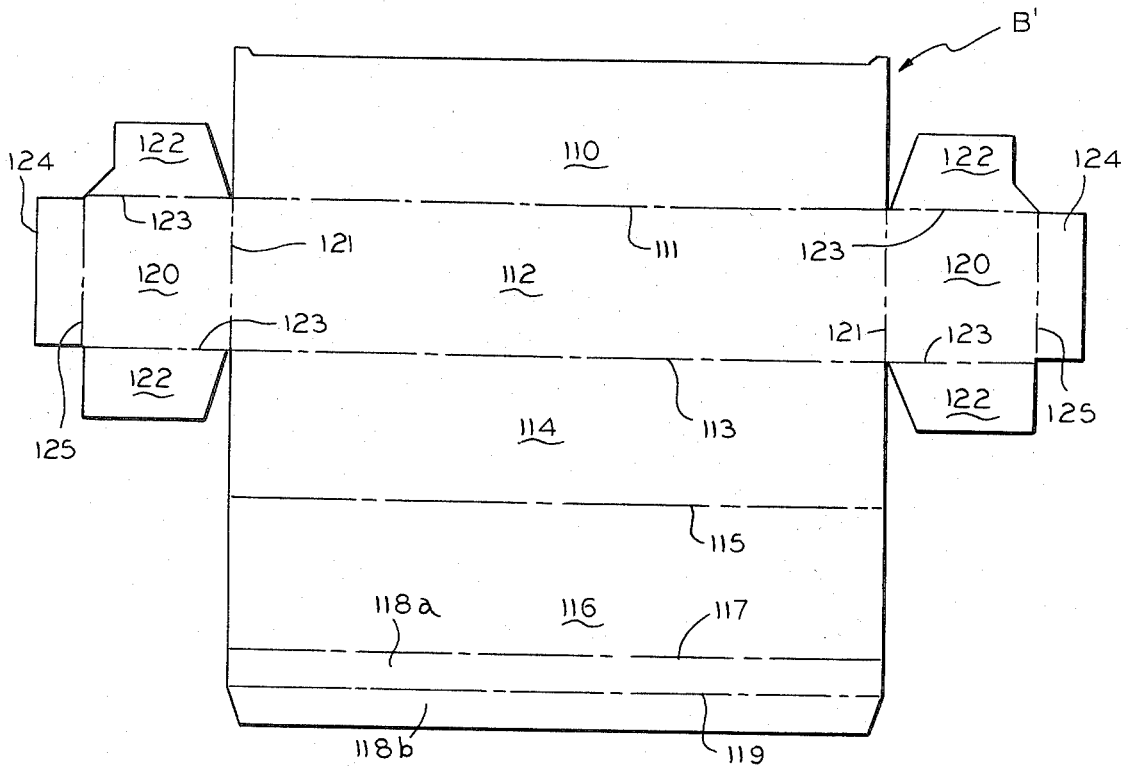

As best seen in FIG. 8, the frame or housing of the dispensing device is a generally tubular construction including a front wall 110, a bottom wall 112, a rear wall 114, an upper wall 116, a first closure flap section 118*a*, and a second closure flap section 118*b* which are foldably joined to each along parallel fold lines 111, 113, 115, 117, and 119, respectively.

Foldably joined along fold lines 121 to opposed edges of bottom wall panel 112 are a pair of end wall panels 120.

Each of the end wall panels 120, have foldably joined along fold lines 123 to opposed front and rear edges thereof, a pair of corner flaps 122. Also foldably joined to the upper edges of each of the end walls 120 on fold lines 125 are dust flaps 124.

In forming the dispensing device, as in the case of the previously described embodiment, the plastic portions are molded into shape and bonded to the paperboard portions in the same insert molding process.

Figure 9:
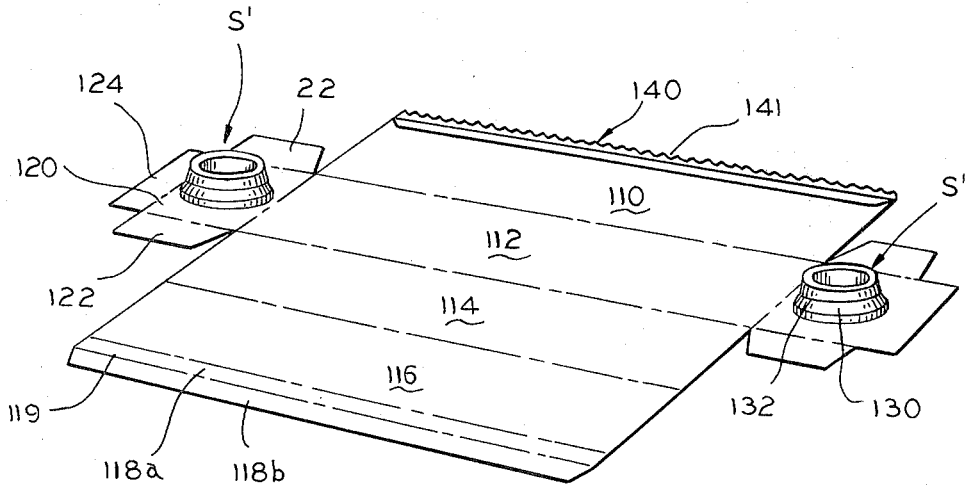
FIG. 9 is a view somewhat similar to that of FIG. 4, except that it is shown in perspective and illustrates the same modification of the invention as depicted in FIGS. 6 through 8.

Referring now to FIG. 9, it will be seen that bonded to the inner surfaces of each of the end walls 120 is a dispensing roll support element indicated generally at S'. Each of the support elements includes an annular base portion 30 and an integral, generally cylindrical skirt portion 32 projecting inwardly from the base portion.

At the same time the support elements S' are formed and secured to the paperboard blank, an elongated plastic cutting strip, indicated generally at 40 and provided with a plurality of serrated cutting teeth 41, is also formed and secured to the upper edge of frame front wall 110.

Thus, after the dispensing device has been formed and it is in the condition illustrated in FIG. 9, it can be erected into a box-like construction, as illustrated in FIGS. 6, 7 and 10, and then can be filled with a roll of material the ends of which are supported on the support elements S'. After the carton has been filled, closure flaps 118*a* and 118*b* can be folded so as to overlie the outer surface of front wall 110, with first section 118*a* being removably adhesively secured to the upper surface of front wall 110, and with second section 118*b* remaining free from attachment to permit it to be readily grasped and the cover pulled apart from the front wall to facilitate access to the roll of material to be dispensed from the dispensing device. The cutting strip 40 serves to permit the material to be cut to the desired length, and, after a portion of the material has been removed from the roll, the closure flap sections 118*a* and 118*b* can be tucked back into the carton behind the front wall 110. Also, in order to secure the carton, the corner flaps 122 may be attached in any desired manner such as by adhesive to the inner faces of front and rear walls 110 and 114, respectively.

Thus, it will be appreciated that this embodiment, like that of the previously described embodiment, presents a device of relatively simple design and construction which is relatively economical to produce by the novel method previously described herein, wherein the plastic portions are made an integral part of the article by forming them and bonding them to the paperboard in a insert injection molding process.

What is claimed is:

1. In a composite molded plastic and paperboard dispensing device formed by an insert molding process, the combination of:

(a) a housing formed from a unitary blank of foldable paperboard and including:
  (i) a bottom wall;
  (ii) a pair of end walls foldably joined to and upstanding from opposite end edges of said bottom wall;

(b) a pair of integral, molded plastic, cylindrical supporting members bonded to opposing surfaces of said end walls by the insert injection molding process and adapted for cooperation with each other to support a roll containing material to be disposed from said roll;

(c) an integral, molded plastic cutting member bonded to said housing by the insert injection molding process and extending between said end walls for cutting material from the roll mounted on said supporting members.

2. A device according to claim 1, wherein said housing includes a display panel detachably joined to one of said end walls.

3. A device according to claim 1, wherein said housing is open between said end walls.

4. A device according to claim 1, wherein said housing is an enclosed box-like structure.

5. A device according to claim 1, wherein said supporting members have interlocking, telescoping engagement with each other.

6. A device according to claim 1, wherein said supporting members are spaced from each other at opposite ends of said housing.

7. A device according to claim 1, wherein said cutting member is bonded to an upper portion of a front wall of said housing.

* * * * *